US009121340B2

(12) United States Patent
Beckman et al.

(10) Patent No.: US 9,121,340 B2
(45) Date of Patent: Sep. 1, 2015

(54) HYDRAULIC POWER SYSTEM FOR A UTILITY VEHICLE

(71) Applicant: Her Majesty the Queen in the Right of Canada as Represented by the Minister of National Defence, Ottawa (CA)

(72) Inventors: Blake Beckman, Medicine Hat (CA); Blaine Fairbrother, Redcliff (CA)

(73) Assignee: Her Majesty the Queen in Right of Canada as Represented by the Minister of Defence, Ottawa (CA)

( * ) Notice: Subject to any disclaimer, the term of this patent is extended or adjusted under 35 U.S.C. 154(b) by 145 days.

(21) Appl. No.: 13/863,101

(22) Filed: Apr. 15, 2013

(65) Prior Publication Data

US 2014/0305387 A1 Oct. 16, 2014

(51) Int. Cl.

| | |
|---|---|
| ***F02B 63/00*** | (2006.01) |
| ***F02B 63/04*** | (2006.01) |
| ***F02B 67/06*** | (2006.01) |

(52) U.S. Cl.

CPC ..... *F02B 63/04* (2013.01); *F02B 63/00* (2013.01); *F02B 67/06* (2013.01); *Y10T 29/49229* (2015.01)

(58) Field of Classification Search

CPC ..... F02B 63/00; F02B 63/04; F02B 63/044; F02B 2063/045; F02B 63/06; F02B 65/00; F02B 67/00; F02B 67/04; F02B 67/06

See application file for complete search history.

(56) References Cited

U.S. PATENT DOCUMENTS

| | | | | |
|---|---|---|---|---|
| 3,181,825 | A | 5/1965 | Jackoboice | |
| 3,641,416 | A | 2/1972 | Riff | |
| 4,826,184 | A | 5/1989 | Kuemichel | |
| 5,743,467 | A | 4/1998 | Mori et al. | |
| 5,847,470 | A | 12/1998 | Mitchell | |
| 6,048,288 | A * | 4/2000 | Tsujii et al. | 477/5 |

(Continued)

FOREIGN PATENT DOCUMENTS

JP 1994144069 5/1994

OTHER PUBLICATIONS

Giesbrecht J., Fairbrother B., Collier J., Beckman B., (2010) Integration of a High Degree of Freedom Robotic Manipulator on a Large Unmanned Ground Vehicle. Proc. of SPIE. vol. 7692 769218.

Hydraulic Bed Lift Kit for the Kawasaki Mule. (2010) http://pdfinside.blogspot.com/2010/09/hydraulic-bed-lift-kit-for-kawasaki.html.

Internet Discussion Board. (2008) Adding belt driven hydraulic pump.

(Continued)

*Primary Examiner* — Lindsay Low
*Assistant Examiner* — Jacob Amick
(74) *Attorney, Agent, or Firm* — Michael R. Williams; Ade & Company Inc.

(57) ABSTRACT

A hydraulic power system for a utility vehicle having an engine with a crankshaft. The system features first and second rotationally-driven power generating devices, one of which is a hydraulic pump and the other of which is an alternator and one of which is a hydraulic pump. The first device has a first rotational input for operative coupling to the crankshaft for driven rotation thereby. A secondary shaft has an input end portion arranged for rotational coupling to a rotationally driven member of the first device and an output end portion arranged for rotational coupling to a second rotational input of the second device for driving thereof under driven operation of the first rotationally-driven power generating device by the crankshaft. Higher power output of increased reliability is provided over prior art add-on hydraulic solutions using electric-over-hydraulic power packs.

20 Claims, 2 Drawing Sheets

(56) References Cited

U.S. PATENT DOCUMENTS

| | | | | |
|---|---|---|---|---|
| 6,101,995 | A | 8/2000 | Itoh et al. | |
| 6,371,072 | B1 * | 4/2002 | Huber | 123/195 A |
| 6,941,924 | B2 | 9/2005 | Morii et al. | |
| 7,082,913 | B2 | 8/2006 | Moriya | |
| 7,868,269 | B2 | 1/2011 | Silvestro | |
| 2010/0056326 | A1 * | 3/2010 | Kahn et al. | 477/3 |
| 2011/0084498 | A1 | 4/2011 | Lemus | |

OTHER PUBLICATIONS

Internet Discussion Board. (2011) How to add a crank mounted hydraulic pump.

Kawasaki Mule 4010 Extra Heavy Duty Hydraulic Snow Plow Kit (2012) http://www.wickedbilt.com/kawasaki_mule/snow_plows/2011_kawasaki_mule_4010_hydraulic_snow_plow_kit.html?pop=0.

Muncie Power Products. (2006) Understanding Truck Mounted Hydraulic Systems, Sixth Edition.

* cited by examiner

HYDRAULIC POWER SYSTEM FOR A UTILITY VEHICLE

FIELD OF THE INVENTION

The present invention relates generally to a hydraulic power system for installation on a utility vehicle to enable use of hydraulically powered ancillary or auxiliary attachments for same, and more particularly to a hydraulic power system using the engine crankshaft as a primary drive input to operate one of a hydraulic pump and an alternator, and using a secondary shaft to drive the other one of the hydraulic pump and alternator.

BACKGROUND OF THE INVENTION

Utility vehicles are off road vehicles that have a side by side seating arrangement and generally have a higher payload or load carrying capacity than an ATV (All Terrain Vehicle). These vehicles are typically purchased by farmers, ranchers, commercial growers, landscapers, etc. and are used in place of larger tractors or construction equipment given their size and lower cost. However, one complaint is that these vehicles typically to not have the ability to run ancillary systems such as buckets, tillers, snow blower, sprayers, chippers, lawn mowers, etc. There is a potential commercial opportunity for these systems as it provides a low cost alternative to the conventional larger systems.

The Kawasaki Mule™ is an example of a commercially available utility vehicle that does not have a factory-provided solution powering ancillary systems using hydraulics.

While there are some available add-on kits for the Mule the involve hydraulic power, including kits for a hydraulic bed and a hydraulic snow plow, the hydraulic power is achieved using a conventional electric-over-hydraulic power pack, in which a 12-volt DC brushed electric motor is powered by the electrical system of the vehicle and connected to a hydraulic pump and reservoir. In use of these system in other products, they have been found acceptable for low duty cycle, low power, linear hydraulic actuators that could run such accessories as a truck bed lift or snow plow blade. However, these systems have been found in some cases to fail if they are run continuously for notable periods of time, for example as little as 20 minutes.

Accordingly, applicant has developed a unique hydraulic power add-on for the Kawasaki Mule that is capable of providing reliable higher power output for extended periods, at least in part by relying on rotational input from the engine crankshaft instead of electrical power for operation of the hydraulic pump.

Although failing to individually or collectively teach or suggest the inventive solution disclosed herein for hydraulic power systems for utility vehicles, prior art references relevant to general areas of hydraulic power systems for vehicles and powering of vehicle related equipment from the engine crankshaft include the following:

Ban T, Mori H, Yagi K. (1998) Automobile Heating System. U.S. Pat. No. 5,743,467 issued Apr. 28, 1998.

Giesbrecht J, Fairbrother B, Collier J, Beckman B. (2010) Integration of a High Degree of Freedom Robotic Manipulator on a Large Unmanned Ground Vehicle. *Proc. of SPIE*. Vol. 7692 769218.

Huber L J. (2002) Method And Apparatus For Mounting A Truck Accessory Power Unit. U.S. Pat. No. 6,371,072 issued Apr. 16, 2002.

Hydraulic Bed Lift Kit for the Kawasaki Mule. (2010) http://pdfinside.blogspot.com/2010/09/hydraulic-bed-lift-kit-for-kawasaki.html Internet Discussion Board. (2008) Adding belt driven hydraulic pump.

Internet Discussion Board. (2011) How to add a crank mounted hydraulic pump.

Itoh K, Kosugi Y, Goto M. (2000) Structure for Mounting of Auxiliary Parts on In-Line Type Multi-Cylinder Engine. U.S. Pat. No. 6,101,995 issued Aug. 15, 2000.

Jackoboice E W. (1965) Generator Pump and Bracket Assembly. U.S. Pat. No. 3,181,825 issued May 4, 1965.

Kawasaki Mule 4010 Extra Heavy Duty Hydraulic Snow Plow Kit. (2012) http://www.wickedbilt.com/kawasaki_mule/snow_plows/2011_kawasaki_mule__4010_hydraulic_snow_plow_kit.html?pop=0

Kuehmiche Kunifumi G, et al. (1994) Hydraulic Driving Device of Auxiliary Equipment for Vehicle. Japanese Patent Publication JP-1994-144069 published May 24, 1994.

Lemus M. (2011) Electrical Generator and Method of Generating Electricity. United States Patent Publication 2011/0084498 published Apr. 14, 2011.

I B G, Kuemichel R J. (1989) Snowmobile Power Steering System. U.S. Pat. No. 4,826,184 issued May 2, 1989.

Mitchell H R. (1998) Auxiliary Motor Drive System. U.S. Pat. No. 5,847,470 issued Dec. 8, 1998.

Morii H, Yatagai Y, Sasaki Y, Shibano K, Matsumura H. (2005) Arrangement and Structure of Auxiliaries in a Snowmobile Engine. U.S. Pat. No. 6,941,924 issued Sep. 13, 2005.

Moriya Y. (2006) Valve Characteristic Changing Apparatus for Internal Combustion Engine. U.S. Pat. No. 7,081,913 issued Aug. 1, 2006.

Muncie Power Products. (2006) Understanding Truck Mounted Hydraulic Systems, Sixth Edition.

Riff J A. (1972) Hydrodynamic Charging System. U.S. Pat. No. 3,641,416 issued Feb. 8, 1972.

Silvestro N. (2011) Integrated Engine Welder and Hydraulic Pump. U.S. Pat. No. 7,868,269 issued Jan. 11, 2011.

SUMMARY OF THE INVENTION

According to a first aspect of the invention there is provided an add-on hydraulic power system for a utility vehicle having an engine with a crankshaft, the system comprising a first rotationally-driven power generating device having a first rotational input for operative coupling thereof to the crankshaft for driven rotation thereby, a second rotationally-driven power generating device having a second rotational input, and a secondary shaft having an input end portion arranged for rotational coupling to a rotationally driven member of the first rotationally-driven power generating device and an output end portion arranged for rotational coupling to the second rotational input for driving of the second rotationally-driven power generating device under driven operation of the first rotationally-driven power generating device by the crankshaft, wherein the first power generating device is one of a hydraulic pump and an alternator and the second power generating device is one of a hydraulic pump and an alternator, provided that the first power generating device; and wherein the first and second rotationally-driven power generating devices are spaced apart from one another in an axial direction parallel to rotational axes of the first and second rotational inputs and face one another end-to-end in said axial direction, and the secondary shaft lies in the axial direction and is radially offset from both the first rotational input of the first rotationally-driven power generating device and the second rotational input of the second rotationally-driven power generating device.

Expressed another way, the first and second power generating devices are opposite ones of an alternator and a hydraulic pump, i.e. wherein one of the first and second power generating devices is an alternator, and the other of the first and second power generating devices is a hydraulic pump.

Preferably there is provided a common mounting bracket on which the first and second rotationally-driven power generating devices and the secondary shaft are all carried.

The common mounting bracket may be arranged for support on the engine.

The first rotationally-driven power generating device may be the hydraulic pump.

Preferably the first and second rotationally-driven power generating devices are spaced apart from one another in an axial direction, the first rotational input and the rotational member of the first rotationally-driven power generating devices are one in the same and are disposed at an end of the first rotationally-driven power generating device opposite the second rotationally-driven power generating device, and the secondary shaft has an axial length spanning in the axial direction from the first rotational input to the second rotational input.

Preferably the second rotational input is disposed at an end of the second rotationally-driven power generating device nearest the first rotationally-driven power generating device.

Preferably an input-end flexible drive member is entrained about the rotationally driven member of the first rotationally-driven power generating device and the secondary shaft to drive rotation thereof under driven rotation of the first rotational input by the crankshaft.

Preferably an output-end flexible drive member is entrained about the second rotational input and the secondary shaft to drive rotation of the second rotational input under driven rotation of the first rotational input by the crankshaft.

Preferably the first rotational input and the driven rotational member of the first rotationally-driven power generating device are one in the same.

When the system is installed in combination with the vehicle, preferably a primary flexible drive member is entrained about the first rotational input and the crankshaft of the engine.

Preferably the primary flexible drive member is also entrained about a rotational input of a water pump of the vehicle.

In one embodiment, the engine is situated in an engine compartment of the vehicle disposed behind an operator compartment of the vehicle, and the first and second rotationally driven power generating devices are mounted between the engine and a forward end of the engine compartment adjacent the operator compartment.

Preferably the system includes a hydraulic fluid reservoir, and hydraulic fluid lines connectable to the hydraulic pump and the fluid reservoir to form a fluid circuit for circulating hydraulic fluid from the reservoir through the pump and through ancillary hydraulic equipment to be powered by the hydraulic pump.

According to a second aspect of the invention there is provided a utility vehicle comprising a hydraulic power system comprising a first rotationally-driven power generating device having a first rotational input operatively coupled to the crankshaft for driven rotation thereby, a second rotationally-driven power generating device having a second rotational input, and a secondary shaft having an input end portion rotationally coupled to a rotationally driven member of the first rotationally-driven power generating device and an output end portion rotationally coupled to the second rotational input for driving of the second rotationally-driven power generating device under driven operation of the first rotationally-driven power generating device by the crankshaft, wherein the first power generating device is one of a hydraulic pump and an alternator and the second power generating device is one of a hydraulic pump and an alternator, provided that the first power generating device, and wherein the first and second rotationally-driven power generating devices are spaced apart from one another, and face toward one another end-to-end, in an axial direction that is parallel to rotational axes of the first and second rotational inputs, and the secondary shaft lies in the axial direction and is radially offset from the rotational axes of both the first rotational input of the first rotationally-driven power generating device and the second rotational input of the second rotationally-driven power generating device.

According to a third aspect of the invention there is provided a method of installing a hydraulic power system on a utility vehicle for driven operation of said hydraulic power system from an engine crankshaft of the vehicle, the method comprising:

(a) obtaining a secondary shaft and first and second power generating devices each having a respective input shaft rotatable on a respective rotational axis, wherein the first power generating device is one of a hydraulic pump and an alternator and the second power generating device is one of a hydraulic pump and an alternator, provided that the first power generating device is a different power generating device from the second power generating device;

(b) mounting the first and second power generating devices and the secondary shaft in an engine compartment of the vehicle such that:

(i) an input pulley on the input shaft of the first power generating device is aligned in a plane of an output pulley on the engine crankshaft for belt-driven operation of the first power generating device by the engine crankshaft;

(ii) the second power generating device is spaced from the first power generating device in an axial direction that is parallel to the rotational axes of the respective input shafts of the first and second power generating devices; and (iii) the secondary shaft is rotatably supported for rotation about a longitudinal axis of the secondary shaft, with the longitudinal axis of the secondary shaft lying in the axial direction at a position radially offset from both of the rotational axes of the respective input shafts of the first and second power generating devices and the secondary shaft being rotationally coupled adjacent opposite ends thereof to a rotational member of the first power generating device and the input shaft of the second power generating device;

whereby engine driven rotation of the engine crankshaft effects belt-driven operation of the first power generating device, and via the secondary shaft, also drives operation of the second power generating device.

Preferably step (b) comprises mounting a common mounting bracket in the engine compartment, the first and second power generating devices and the secondary shaft all being carried on the common mounting bracket.

Preferably the rotational member of the first power generating device to which the secondary shaft is rotationally coupled is the input shaft of the first power generating device.

Preferably the secondary shaft is rotationally coupled to the rotation member of the first power generating device and to the input shaft of the second power generating device by respective belts.

The method may comprise substituting the alternator for a previously installed alternator by removing said previously installed alternator prior to step (b), and installing the first power generating device in place of said previously installed alternator.

The system according to the first aspect of the invention may be provided in kit form, including instructions for performing step (b) of the above method. The instructions may be provided in printed text or printed illustration/photographic form, or combination thereof, in video form showing steps of a recorded or animated installation process, whether alone or in combination with verbal or readable content, or in electronically stored text, illustration/photographic, and/or video data on a computer readable medium for viewing of text, image or video content using suitable software on a suitably equipped computer or electronic device. The instructions may be package together with the other components, or provided separately, for example through electronic delivery or retrieval, such as by providing the user with a website address for online viewing or download of the instructions.

BRIEF DESCRIPTION OF THE DRAWINGS

In the accompanying drawings, which illustrate exemplary embodiments of the present invention.

DETAILED DESCRIPTION

Figure 1:
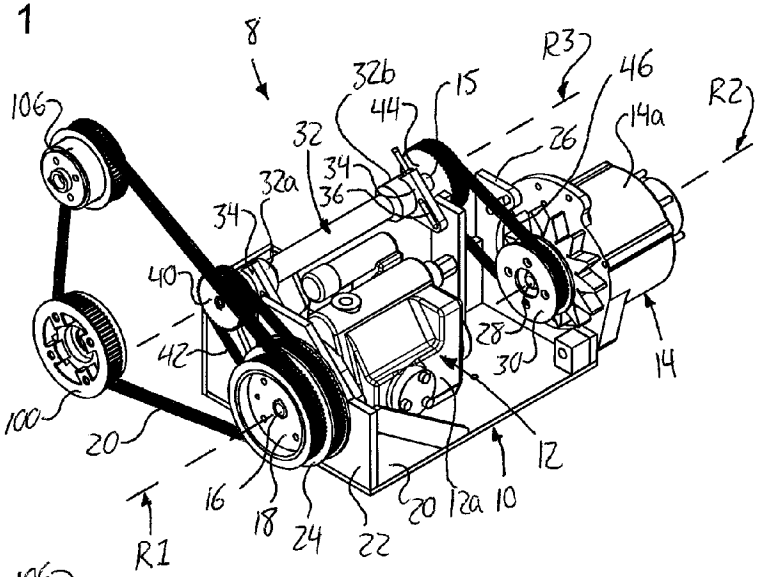
FIG. 1 is a perspective view showing a mount assembly carrying a hydraulic pump, actuator and connection shaft of an add-on hydraulic power system for a utility vehicle, and illustrating belt-driven operation of these components from an engine crankshaft of the vehicle.
Figure 2:
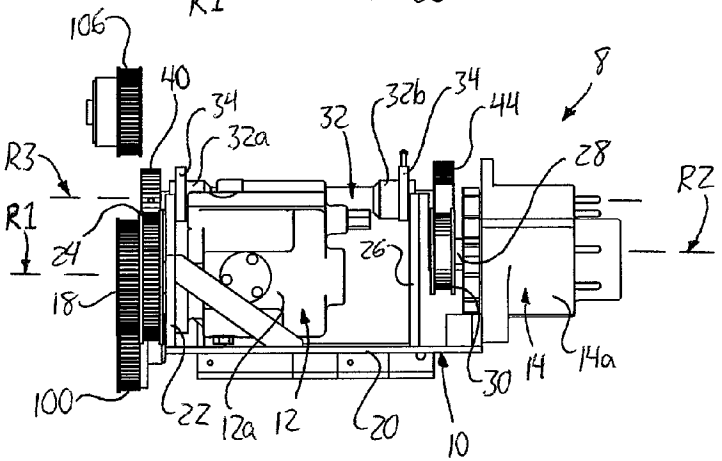
FIG. 2 is a front elevational view of the mount assembly of FIG. 1, with drive belts thereof omitted.
Figure 3:
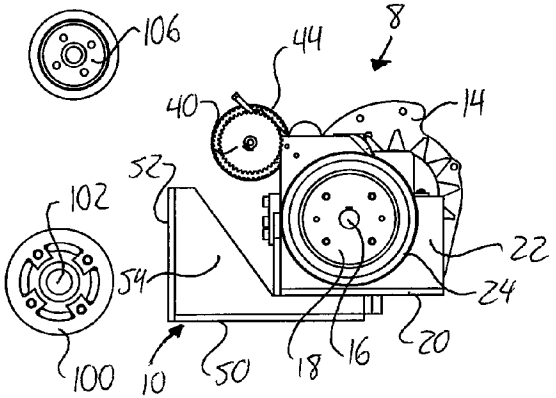
FIG. 3 is a side elevational view of the mount assembly of FIG. 1, with the drive belts thereof again omitted.

FIGS. 1-3 illustrates an assembly for installation into the engine compartment of a utility vehicle to add a hydraulic power take off system to same. The illustrated embodiment reflects a prototype of the present invention developed particularly for the Kawasaki Mule utility vehicle, but it will be appreciated that advantageous features of the illustrated embodiment may be likewise exploited in similar systems tailored for other utility vehicles. Likewise, although the illustrated embodiment is configured as an add-on kit suitable for sale to consumers for addition to their existing vehicles, for example by a performance aftermarket distributor, it will be appreciated that a similar system may be factory-installed as original equipment, or offered as an optional package or feature to added to a custom-ordered vehicle by the vehicle manufacturer or seller.

The assembly 8 of FIGS. 1 to 3 features four major components, particularly a mounting bracket structure 10, and a hydraulic pump 12, alternator 14, and connecting shaft 15 all supported on the mounting bracket. The hydraulic pump 12 provides hydraulic power for auxiliary or ancillary attachments or equipment for the vehicle, and the alternator 14 replaces the vehicle's previous factory-specified alternator in order to generate electrical power for the vehicle's electrical system in a conventional manner, and provide increased electrical output to allow running of electrical aspects of the attachment or equipment from the vehicle's electrical system. The configuration breaks away from the convention of the aforementioned prior art, where a hydraulic pump is driven with a DC motor powered by the vehicle's onboard battery, as charged by the vehicle's factory-specified alternator driven off the engine crankshaft, and instead mechanically drives the hydraulic pump from the engine crankshaft. The connecting shaft 15 provides a secondary drive for running the alternator 14 from off the same mechanical drive as the hydraulic pump without a conversion in energy type between the two (for example, without using hydraulic output from the pump to drive a hydraulic motor for converting the hydraulic power back into mechanical rotation to drive the alternator).

With continued reference to FIG. 1, the hydraulic pump 12 features an input shaft 16 that defines the rotational axis R1 of the hydraulic pump. Fixed to the hydraulic pump input shaft 16 near the distal end thereof outside the pump housing 12*a* is an input pulley 18. To prepare the vehicle for installation of the assembly 8, the vehicle's existing alternator is removed, along with a cooling fan (not shown) normally attached to an input pulley 106 of the vehicle's water pump 108 and the drive belt that formerly drove the now-removed alternator along with the water pump and the now-removed cooling fan. With these components removed, the mounting bracket and the components are installed in the engine compartment of the vehicle. With the assembly so installed, the input pulley 18 of the hydraulic pump is situated in a same vertical plane as an output pulley 100 on the crankshaft 102 of the vehicle's engine 104, which is also the plan in which the input pulley 106 of the water pump 108 resides, and in which the input pulley of the removed alternator used to reside. This way, a primary drive belt 20 can be entrained in a closed loop around the crankshaft output pulley 100, the hydraulic pump input pulley 18, and the water pump input pulley 106, after which the cooling fan can then be re-attached to the water pump pulley 106. Depending on differences in the size and/or position of the hydraulic pump input pulley versus that of the removed alternator, the primary drive belt 104 may be the same belt as, or direct equivalent replacement of, the vehicle's previous belt, or may be a different belt whose dimensions are selected according to the new pulley size and/or position.

The mounting bracket 10 features a horizontal lower wall 20 over which the body of the hydraulic pump 12 resides. The input shaft 16 of the hydraulic pump passes through an opening in a respective vertical end wall 22 of the mounting bracket that is upstanding from the lower wall 20 at one end thereof. The pump 12 may be mounted to the bracket by bolting of the pump housing 12*a* to this end wall 22. On the side of the end wall 22 opposite the pump housing 12*a*, an output pulley 24 fixed on the input shaft 16 of the hydraulic pump 12 resides between the wall 22 and the input pulley 18 of this input shaft 16.

At a second vertical end wall 26, which lies opposite and parallel to the first end wall at the other end of the lower wall 20, the alternator housing 14*a* is bolted to the end wall 26 for similar support of the alternator on the bracket 10. However, the alternator housing 14*a* projects outward from the respective end wall 26 instead of projecting inward therefrom to lie over the lower wall 20 of the bracket. The end wall 26 features a cutaway or opening through which an input shaft 28 of the alternator passes from the alternator housing 14*a* in order to carry an input pulley 30 fixed on the distal end of this input shaft 28 on the inside of the respective end wall 26 at a position over the lower wall 20.

The input pulley of the hydraulic pump is located at an end of the pump that is opposite and facing away from the alternator, while the input pulley of the alternator is located at an end thereof nearest and facing toward the hydraulic pump. It may be possible to have the input pulley of the alternator at the other end, but this would increase the connecting shaft length that would be required to rotatably link the alternator and pump together in the manner described below. The alternator's rotational axis R2, as defined by the input shaft 28 thereof, is parallel to that of the hydraulic pump, but is not necessarily coincident or aligned therewith. For example, in the illustrated embodiment, the alternator axis is horizontally offset from the pump axis to a side thereof opposite the connecting shaft 15, and vertically offset a short height above the elevation of the pump's axis.

The connecting shaft 15 is journaled inside an outer sleeve 32 by bearings disposed within enlarged end portions 32*a*, 32*b* of the sleeve. The shaft's longitudinal axis lies parallel to the rotational axes R1, R2 of the hydraulic pump and alternator, and defines the rotational axis R3 on which the shaft 15 is rotatably supported by the bearings of the sleeve 32. One end portion 32*a* of the sleeve 32 is carried on the same end wall 24 of the bracket 10 as the hydraulic pump by a respective support plate 34 bolted to an inner side of the end wall 24 through an elongated slot 36 of the support plate 34. An intermediate vertical wall 38 parallel to the end walls 22, 26 of the mounting bracket 10 at a location between these two end walls and closer to the alternator-carrying end wall 26 likewise carries a respective slotted support plate 34 that carries the other end portion 32*b* of the sleeve 32. Two bolts engage through the elongated slot 36 of the support plate and through a pair of bolt holes in the intermediate wall 38, whereby the position of support plate can be adjusted along the elongated direction of the slot when the bolts are loosened. The other support plate is adjustable on the pump-carrying end wall 22 in the same manner. The slots 36 of the support plates lie in vertical planes parallel to the vertical walls 22, 26, 38, with the elongation direction of each slot lying at an oblique angle in this plane so as to extend upwardly away from the rotational axes R1, R2 of the hydraulic pump and alternator. Through this adjustable supports of its ends, the sleeve 32 can be shifted toward and away from the alternator and pump axes, and then fastened in place by tightening of the bolts.

An input end 15*a* of the connecting shaft 15 projects outward from the respective end portion 32*a* of the sleeve 32 and carries a respective input pulley 40 fixed thereon. This input pulley resides in the same vertical plane as the output pulley 24 on the input shaft 16 of the hydraulic pump such that a first intermediate drive belt 42 can be entrained in a closed loop around these pulleys so as to drive rotation of the connecting shaft 15 from the input end 15*a* thereof under driven rotation of the hydraulic pump input shaft 16 from the engine crankshaft 102 and primary drive belt 20. An output end 15*b* of the connecting shaft 15 projects outward from the respective end portion 32*b* of the sleeve 32 and carries a respective output pulley 44 fixed thereon. This output pulley resides in the same vertical plane as the input pulley 30 on the input shaft 28 of the alternator 14 such that a second intermediate drive belt 46 can be entrained around these pulleys so as to drive rotation of the alternator input shaft 28 from the output end 15*b* of the connecting shaft 15. The adjustable mounting of the shaft-carrying sleeve 32 on the mounting bracket allows the tension of these intermediate drive belts to be adjusted by shifting the shaft 15 toward and away from the rotational axes of the hydraulic pump and alternator.

The lower wall 20 and end and intermediate walls 22, 26, 38 of the mounting bracket 10 form a carrying portion of the bracket on which the hydraulic pump 12, alternator 14 and connecting shaft 15 are all carried. A mounting portion 48 of the illustrated bracket features a bottom wall 50 that lies parallel to and juts outward from under lower wall 20 of the carrying portion in a horizontal direction past the vertical plane of the connecting shaft axis R3, thus spanning outwardly past the shaft sleeve 32 to a side thereof opposite the hydraulic pump 12 and alternator 14. A vertical rear wall 52 stands upward from the bottom wall 50 in a plane parallel to the rotational axes R1, R2, R3 and features bolt holes therein, which are arranged in a pattern matching fastening holes of existing mounting bosses on the engine block of the vehicle. Generally triangular reinforcements 54 span between the rear wall 52 and bottom wall 50 at spaced positions thereon in vertical planes perpendicular to the rear and bottom walls to better support the weight of the carrying portion of the mounting bracket and the components carried thereon.

While using existing mounting points on the engine block provides significant ease of installation with minimal or no modification to the vehicle, it will be appreciated that other support bracket configurations may be used while stilling having the advantage of using a pre-assembled configuration that carries the pump, alternator and connecting shaft on a common bracket to avoid the need for individual and separate mounting of these components.

Figure 4:
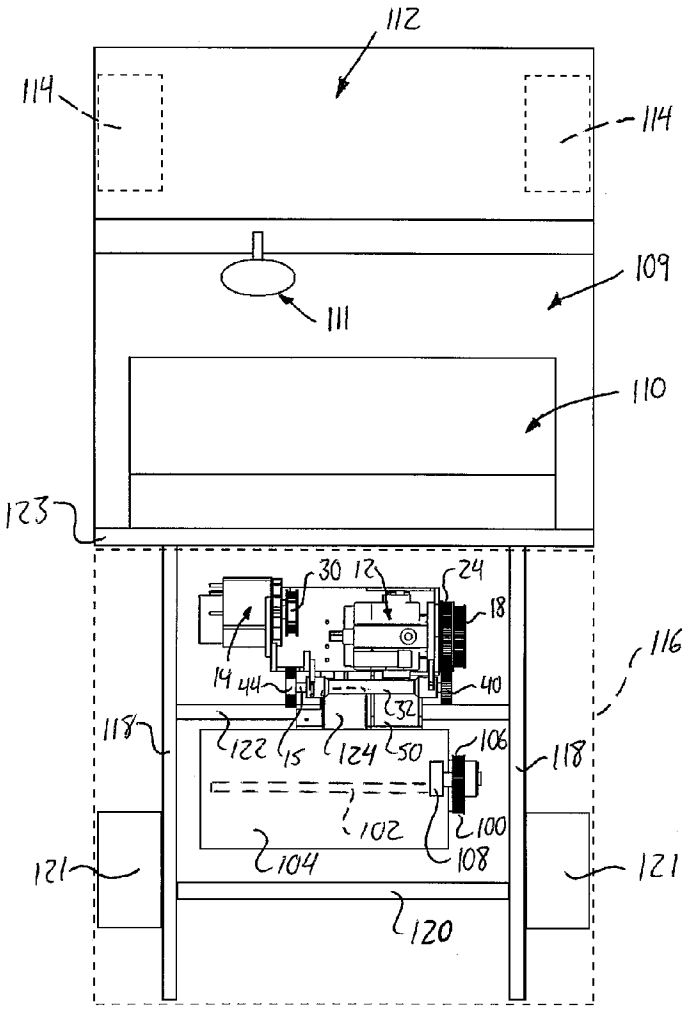
FIG. 4 is an overhead plan view showing the mounting assembly of FIG. 1, with the drive belt thereof again omitted, and schematically illustrating installation of the mounting assembly in an engine compartment of the vehicle.

FIG. 4, while not drawn to scale, schematically illustrates an overhead plan view of the above described assembly once installed in the engine compartment of a Kawasaki Mule utility vehicle. The general layout of the vehicle features a driver/operator compartment 109 with a driver and passenger bench seat 110 and driver/operator controls (represented by schematically illustrated steering wheel 111) disposed behind a short hood-like area 112 at the front of vehicle, beneath which the front wheels 114 are disposed at laterally outward positions thereunder. This particular model of utility vehicle does not feature an enclosed cabin, and so it will be appreciated that the term 'compartment' is used herein not to specifically denote an enclosed space, but is used in its more general sense to refer to an area separated or divided from another. Behind the driver/operator compartment 109 is a cargo bed 116 for carrying equipment or materials, and it is beneath this cargo bed that the engine 104 of the vehicle is installed. The cargo bed is shown in broken lines so as to reveal the schematically illustrated components mounted in the engine compartment beneath it.

The engine block 104 resides between a pair of longitudinal members 118 of the vehicle frame. A horizontal upper cross member 120 spans perpendicularly between the longitudinal frame members 110 behind the engine above and slightly behind and above the rotational axes of the vehicle's rear tires 121 that reside laterally outside the longitudinal frame members 118. A lower cross-member 122 spans horizontally and perpendicularly between the longitudinal frame members 118 in front of the engine. The crankshaft 102 of the engine lies parallel to the cross-members and perpendicular to the longitudinal frame members, with the output pulley 100 of the crankshaft disposed between the engine and the longitudinal frame member on the passenger side of the vehicle. The water pump 108 resides at this same side of the engine with its input pulley 106 disposed at an elevation above the crankshaft pulley. The original alternator (not shown) is normally carried by a bracket in front of the engine between the engine and the vertical plane of the dividing wall or structure 123 that spans transversely of the vehicle to lie parallel to the cross members and divide this engine compartment area from the operator compartment in front thereof.

With the assembly of the illustrated embodiment of the present invention installed, the bottom wall 50 of the mounting bracket spans forwardly from the engine block 104 over the lower cross-member 122 and below a starter motor 124 mounted to the front side of the engine block at a height above the lower cross-member. The hydraulic pump 12 occupies an area similar to that occupied by the original alternator, which is removed during installation of the illustrated embodiment of the present invention. That is, the hydraulic pump of the assembly takes on the general physical position of the former alternator, while the alternator of the assembly functionally replaces the former alternator. The input pulley 18 of the hydraulic pump thus takes the place of the original alternator pulley, completing a triangular configuration with the crankshaft and water pump pulleys 100, 106 at a location forward of the engine at a height well below the water pump pulley 106 and slightly above the crankshaft pulley 100. The rear wall 52 of the mounting bracket 10 is bolted to the engine block 104 to carry the other components in front of the engine, i.e. between the engine and the barrier between the engine compartment and the operator compartment. The primary drive belt 20 is entrained around the crankshaft pulley 100, water pump pulley 106 and hydraulic pump input pulley 18.

The primary drive belt thus drives the input shaft of the hydraulic pump, which not only provides direct-mechanical driving of the hydraulic pump, but also provides a mechanical drive input to the connecting shaft 15 via the first intermediate drive belt 42. The connecting shaft thus forms a secondary drive shaft which provides a purely mechanical drive connection to the input of the alternator 14 via the second intermediate drive belt 46, with no intervening conversion to hydraulic or electric power in the transfer of alternator-driving power from the hydraulic pump to the alternator. The positioning of the connection shaft 15 at an elevation below the water pump pulley, but at an elevation above the pulleys on the input shafts of the hydraulic pump and alternator, provides a suitable position in the engine compartment, whereby the connecting shaft spans over the starter motor 112 at front side of the engine block.

Figure 5:
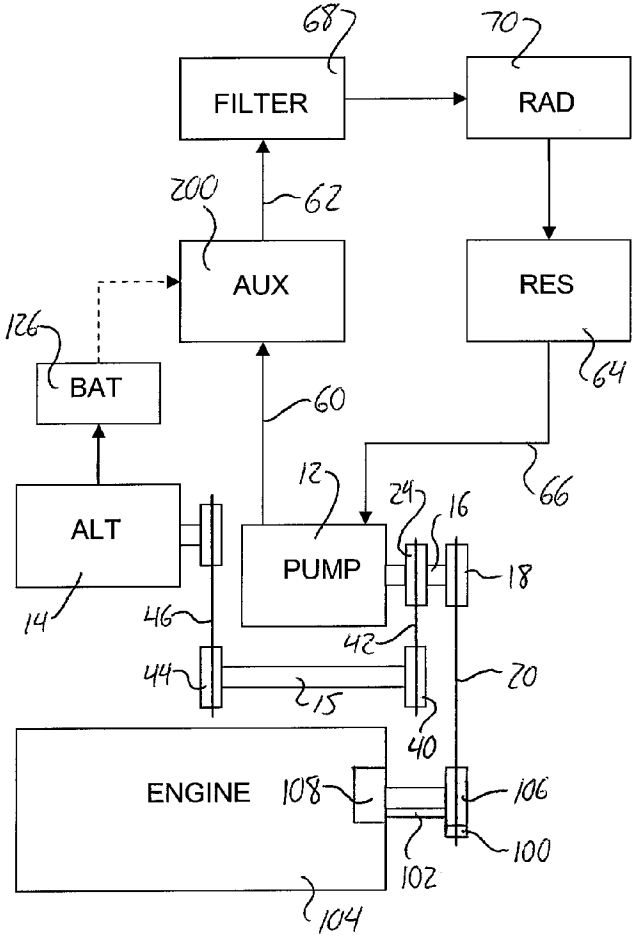
FIG. 5 is a schematic illustration of the add-on hydraulic power system and use thereof to drive ancillary equipment attached to the utility vehicle.

Turning to FIG. 5, the hydraulic power system of the present invention is completed by the addition of hydraulic components for forming a hydraulic circuit for feeding the hydraulically powered ancillary or auxiliary equipment 200, which may be any of a variety of known types. A hydraulic supply line 60 is coupled to the fluid outlet of the hydraulic pump 12 and has a suitable length and a suitable hydraulic fitting at the other end thereof for releasable fluid-tight connection to the fluid supply inlet of the hydraulically driven equipment 200. Likewise a return line 62 of suitable length has a suitable fitting for releasable connection to the fluid return outlet of the equipment at one end. The other end of the return line 62 feeds back into vehicle-carried components of the hydraulic circuit which are installed somewhere on the vehicle. At minimum, this includes a hydraulic fluid reservoir 64 that is fluidly coupled to the hydraulic pump through a connection line 66 for drawing of fluid from the reservoir under operation of the pump. As illustrated, the system may also include a hydraulic fluid filter 68 and a hydraulic oil radiator 70 or other cooler installed within the hydraulic circuit. Unlike the components of the pump/alternator/shaft assembly, which are mechanically linked to the engine and to one another, the hydraulic circuit components need be linked only by flexible fluid lines or conduits, and accordingly can be placed in any of a variety of possible positions on the vehicle. Accordingly, details of where and how these components are mounted are not outlined in further detail herein.

As schematically illustrated in FIG. 5, the alternator is connected to the electrical system of the vehicle in a conventional manner to charge the battery 126 thereof. In a prototype of the present invention, the system of the present invention replaced the original factory-specified 12-Volt, 40-Amp alternator with a higher output 24-Volt, 50-Amp alternator in order to increase the electrical load capacity of the vehicle electrical system to handle added electrical loads of auxiliary or ancillary equipment requiring electrical power. It may be possible that other embodiments need not replace the original alternator, and for example may have the mounting bracket configured to support the original alternator, for example particularly for embodiments intended primarily or solely to address the need for hydraulic power, and where additional electrical load capacity is therefore considered unnecessary or of secondary importance.

The illustrated embodiment has the hydraulic pump as the first power generating device that is rotationally driven directly from the engine crankshaft, and the alternator as the second power generating device is that is rotationally driven through the secondary drive means provided by the connecting shaft. This reflects a prototype of the invention in which this particular configuration was selected for power requirements and mechanical consideration. Regarding the power considerations, the hydraulic pump used in the prototype required approximately 5 horse power maximum input power, and the alternator required approximately 1 horse power. With the relatively short belts used to rotationally couple the connecting shaft to the pump and the alternator, as dictated by limited spacing in the engine compartment, sufficient power for operation of the hydraulic pump could not be provided at the output end of the connection shaft. Regarding the mechanical considerations, the hydraulic pump used in the prototype is of a type designed to be directly coupled to a drive belt and accordingly has a large bearing and shaft capable of being used to transfer the power to both itself and to the alternator. The alternator's drive shaft was not strong enough to be used to transfer the load to the hydraulic pump in a reverse configuration.

However, other embodiments may feature the reverse positioning of the pump and alternator relative one another, whereby the alternator would use the primary drive from the crankshaft and the pump would use the secondary drive from the connection shaft. In one embodiment, this could be accomplished by adding bearing block and another shaft coupling to allow use of the alternator input shaft to also drive the hydraulic pump via the connecting shaft. Alternatively or additionally, use of different combinations of makes, models, or power ratings of alternator and/or pump may allow use of the alternator as the primary drive.

In summary of the detailed embodiment disclosed herein, which is based on a tested prototype of the present invention, a hydraulic power supply was incorporated into a Kawasaki Mule utility vehicle, and constructed in a way so as to integrate each required component into the chassis and powertrain. The resulting vehicle is reliably engineered and can operate with the same maintenance schedule as the factory-original vehicle, or conceivably operate for even longer than the current system before scheduled maintenance.

At the macro level, the prototype provides a hydraulic Power Take Off (PTO) capable of approximately 5-hp output power on a Kawasaki Mule Utility vehicle. These types of vehicles do not come from the factory with any form of PTO to run ancillary systems. At the micro level the hydraulic pump, alternator, tank, filter, radiator, hoses, fittings, fluid, connectors, gages, etc, were all tightly integrated onto the existing utility vehicle. The utility vehicle remains virtually standard (i.e. unmodified) with this power package being seamlessly integrated. The main assembly provides a mechanical power transfer using a secondary shaft and belt tension system, fitting the assembly within the extremely small space available by placing the hydraulic pump and alternator axially in front and behind each other with their axes lying in the transverse or cross-wise direction of the vehicle. The solution does not extensively modify the existing systems of the vehicle, instead providing a simple bolt-on solution that provides the required hydraulic power. The resulting upgrade consists of a single primary belt driving the water pump and hydraulic pump from the crankshaft while a secondary shaft, driven off the hydraulic pump, drives the alternator. This setup allows for efficient use of space and allows each subsystem to be driven at their respective optimal speeds.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An add-on hydraulic power system for a utility vehicle having an engine with a crankshaft, the system comprising a first rotationally-driven power generating device having a first rotational input for operative coupling thereof to the crankshaft for driven rotation thereby, a second rotationally-driven power generating device having a second rotational input, and a secondary shaft having an input end portion arranged for rotational coupling to a rotationally driven member of the first rotationally-driven power generating device and an output end portion arranged for rotational coupling to the second rotational input for driving of the second rotationally-driven power generating device under driven operation of the first rotationally-driven power generating device by the crankshaft, wherein the first power generating device is one of a hydraulic pump and an alternator and the second power generating device is one of a hydraulic pump and an alternator, provided that the first power generating device is a different power generating device from the second power generating device; and wherein the first and second rotationally-driven power generating devices are spaced apart from one another in an axial direction parallel to rotational axes of the first and second rotational inputs and face one another end-to-end in said axial direction, and the secondary shaft lies in the axial direction and is radially offset from both the first rotational input of the first rotationally-driven power generating device and the second rotational input of the second rotationally-driven power generating device.

2. The system of claim 1 comprising a common mounting bracket, wherein the first and second rotationally-driven power generating devices and the secondary shaft are all carried on the same common mounting bracket.

3. The system of claim 1 wherein the common mounting bracket is arranged for support on the engine.

4. The system of claims 1 wherein the first rotationally-driven power generating device is the hydraulic pump.

5. The system of claim 1 wherein the first rotational input and the rotational member of the first rotationally-driven power generating devices are one in the same and disposed at an end of the first rotationally-driven power generating device opposite the second rotationally-driven power generating device, and the secondary shaft has an axial length spanning in the axial direction from the first rotational input to the second rotational input.

6. The system of claim 5 wherein the second rotational input is disposed at an end of the second rotationally-driven power generating device nearest the first rotationally-driven power generating device.

7. The system of claim 1 wherein an input-end flexible drive member is entrained about the rotationally driven member of the first rotationally-driven power generating device and the secondary shaft to drive rotation thereof under driven rotation of the first rotational input by the crankshaft.

8. The system of claim 1 wherein an output-end flexible drive member is entrained about the second rotational input and the secondary shaft to drive rotation of the second rotational input under driven rotation of the first rotational input by the crankshaft.

9. The system of claim 1 wherein the first rotational input and the driven rotational member of the first rotationally-driven power generating device are one in the same.

10. A utility vehicle comprising a hydraulic power system comprising a first rotationally-driven power generating device having a first rotational input operatively coupled to a crankshaft of an engine of the utility vehicle for driven rotation thereby, a second rotationally-driven power generating device having a second rotational input, and a secondary shaft having an input end portion rotationally coupled to a rotationally driven member of the first rotationally-driven power generating device and an output end portion rotationally coupled to the second rotational input for driving of the second rotationally-driven power generating device under driven operation of the first rotationally-driven power generating device by the crankshaft, wherein the first power generating device is one of a hydraulic pump and an alternator and the second power generating device is one of a hydraulic pump and an alternator, provided that the first power generating device is a different power generating device from the second power generating device, and wherein the first and second rotationally-driven power generating devices are spaced apart from one another, and face toward one another end-to-end, in an axial direction that is parallel to rotational axes of the first and second rotational inputs, and the secondary shaft lies in the axial direction and is radially offset from the rotational axes of both the first rotational input of the first rotationally-driven power generating device and the second rotational input of the second rotationally-driven power generating device.

11. The vehicle of claim 10 wherein a primary flexible drive member is entrained about the first rotational input and the crankshaft of the engine.

12. The vehicle of claim 11 wherein the vehicle comprises a water pump and the primary flexible drive member is also entrained about a rotational input defined of the water pump.

13. The system of claim 1 comprising a hydraulic fluid reservoir, hydraulic fluid lines connectable to the hydraulic pump and the fluid reservoir to form a fluid circuit for circulating hydraulic fluid from the reservoir through the pump and through ancillary hydraulic equipment to be powered by the hydraulic pump.

14. The vehicle of claim 10 wherein the engine is situated in an engine compartment of the vehicle disposed behind an operator compartment of the vehicle, and the first and second rotationally driven power generating devices are mounted between the engine and a forward end of the engine compartment adjacent the operator compartment.

15. A method of installing a hydraulic power system on a utility vehicle for driven operation of said hydraulic power system from an engine crankshaft of the vehicle, the method comprising:

(a) obtaining a secondary shaft and first and second power generating devices each having a respective input shaft rotatable on a respective rotational axis, wherein the first power generating device is one of a hydraulic pump and an alternator and the second power generating device is one of a hydraulic pump and an alternator, provided that the first power generating device is a different power generating device from the second power generating device;

(b) mounting the first and second power generating devices and the secondary shaft in an engine compartment of the vehicle such that:

(i) an input pulley on the input shaft of the first power generating device is aligned in a plane of an output pulley on the engine crankshaft for belt-driven operation of the first power generating device by the engine crankshaft;

(ii) the second power generating device is spaced from the first power generating device in an axial direction that is parallel to the rotational axes of the respective input shafts of the first and second power generating devices; and (iii) the secondary shaft is rotatably supported for rotation about a longitudinal axis of the secondary shaft, with the longitudinal axis of the secondary shaft lying in the axial direction at a position radially offset from both of the rotational axes of the respective input shafts of the first and second power generating devices and the secondary shaft being rotationally coupled adjacent opposite ends thereof to a rotational member of the first power generating device and the input shaft of the second power generating device;

whereby engine driven rotation of the engine crankshaft effects belt-driven operation of the first power generating device, and via the secondary shaft, also drives operation of the second power generating device.

16. The method of claim 15 wherein step (b) comprises mounting a common mounting bracket in the engine compartment, the first and second power generating devices and the secondary shaft all being carried on the common mounting bracket.

17. The method of claim 15 wherein the rotational member of the first power generating device to which the secondary shaft is rotationally coupled is the input shaft of the first power generating device.

18. The method of claim 15 wherein the secondary shaft is rotationally coupled to the rotation member of the first power generating device and to the input shaft of the second power generating device by respective belts.

19. The method of claim 15 comprises substituting the alternator for a previously installed alternator by removing said previously installed alternator prior to step (b), and installing the first power generating device in place of said previously installed alternator.

20. The utility vehicle of claim 10 wherein the first and second power generating devices and the secondary shaft all reside on a same side of the engine.

* * * * *